US009142885B2

(12) United States Patent
Chen

(10) Patent No.: US 9,142,885 B2
(45) Date of Patent: Sep. 22, 2015

(54) WIRELESS COMMUNICATION MODULES WITH REDUCED IMPEDANCE MISMATCH

(71) Applicant: Quanta Computer Inc., Kuei Shan Hsiang, Tao Yuan Shien (TW)

(72) Inventor: Shuenn-Shyan Chen, Tao Yuan Shien (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 102 days.

(21) Appl. No.: 14/185,239

(22) Filed: Feb. 20, 2014

(65) Prior Publication Data

US 2015/0155620 A1 Jun. 4, 2015

(30) Foreign Application Priority Data

Dec. 2, 2013 (TW) ..... 102143984 A

(51) Int. Cl.
*H01Q 1/50* (2006.01)
*H01Q 1/38* (2006.01)
*H01Q 1/42* (2006.01)

(52) U.S. Cl.
CPC . *H01Q 1/38* (2013.01); *H01Q 1/42* (2013.01); *H01Q 1/50* (2013.01)

(58) Field of Classification Search
CPC ..... H01Q 1/50; H01Q 1/42; H01Q 1/38; H01Q 21/28
USPC ..... 343/872, 725, 900, 906
See application file for complete search history.

(56) References Cited

U.S. PATENT DOCUMENTS

| | | | | |
|---|---|---|---|---|
| 2006/0176238 | A1* | 8/2006 | Lee | 343/897 |
| 2011/0298673 | A1* | 12/2011 | Zhang | 343/703 |
| 2012/0106036 | A1* | 5/2012 | Kao | 361/679.01 |
| 2012/0313836 | A1* | 12/2012 | Chou | 343/893 |
| 2014/0191908 | A1* | 7/2014 | Lin | 343/702 |

* cited by examiner

*Primary Examiner* — Lam T Mai
(74) *Attorney, Agent, or Firm* — McClure, Qualey & Rodack, LLP

(57) ABSTRACT

A wireless communication module is disclosed. A circuit board includes a first sidewall, a second sidewall, and a third sidewall. The second sidewall is perpendicular to and connected between the first and third sidewalls. Multiple interlayer traces are formed in the circuit board. An antenna integrated circuit is disposed on the second sidewall of the circuit board and is connected to the interlayer traces. An antenna is formed on the first sidewall of the circuit board. One of the interlayer traces is connected between the antenna integrated circuit and the antenna. At least one external solder pad is formed on the third sidewall of the circuit board. Another one of the interlayer traces is connected between the antenna integrated circuit and the external solder pad.

10 Claims, 3 Drawing Sheets

WIRELESS COMMUNICATION MODULES WITH REDUCED IMPEDANCE MISMATCH

CROSS REFERENCE TO RELATED APPLICATIONS

This application claims priority of Taiwan Patent Application No. 102143984, filed on Dec 2, 2013, the entirety of which is incorporated by reference herein.

BACKGROUND OF THE INVENTION

1. Field of the Invention

The invention relates to wireless communication modules, and more particularly to wireless communication modules with reduced impedance mismatch.

2. Description of the Related Art

Referring to FIG. 1, a conventional wireless communication module 1 comprises a circuit board 10, an antenna integrated circuit 20, and an antenna 30.

The antenna integrated circuit 20 and antenna 30 are disposed on two opposite surfaces of the circuit board 10, respectively. Here, the antenna integrated circuit 20 controls operation of the antenna 30 and transmission of signals.

Moreover, the circuit board 10 comprises a via 11 formed therein. Specifically, the via 11 penetrates the whole circuit board 10 to connect the antenna integrated circuit 20 to the antenna 30. Thus, the antenna integrated circuit 20 can be electrically connected to the antenna 30, enabling the antenna integrated circuit 20 to control the operation of the antenna 30.

Nevertheless, as the via 11 penetrating the whole circuit board 10 is often provided with a long conductive path, impedance between the antenna integrated circuit 20 and the antenna 30 cannot be controlled well, easily causing an impedance mismatch problem, and further resulting in RF (radio frequency) trace loss of the wireless communication module 1. Thus, the performance of the wireless communication module 1 deteriorates due to the impedance mismatch and RF trace loss.

BRIEF SUMMARY OF THE INVENTION

A detailed description is given in the following embodiments with reference to the accompanying drawings.

An exemplary embodiment of the invention provides a wireless communication module comprising a circuit board, a plurality of interlayer traces, an antenna integrated circuit, an antenna, and at least one external solder pad. The circuit board comprises a first sidewall, a second sidewall, and a third sidewall. The second sidewall is perpendicular to the first and third sidewalls and is connected between the first and third sidewalls. The interlayer traces are formed in the circuit board. The antenna integrated circuit is disposed on the second sidewall of the circuit board and is connected to the interlayer traces. The antenna is formed on the first sidewall of the circuit board. One of the interlayer traces is connected between the antenna integrated circuit and the antenna. The external solder pad is formed on the third sidewall of the circuit board. Another one of the interlayer traces is connected between the antenna integrated circuit and the external solder pad.

The wireless communication module further comprises a first via connected between one of the interlayer traces and the antenna.

The wireless communication module further comprises a second via connected between another one of the interlayer traces and the external solder pad.

The wireless communication module further comprises a cover disposed on the second sidewall of the circuit board and covering the antenna integrated circuit.

Another exemplary embodiment of the invention provides a wireless communication module comprising a circuit board, a plurality of interlayer traces, an antenna integrated circuit, an antenna, and at least one external solder pad. The circuit board comprises a first sidewall, a second sidewall, and a third sidewall. The first sidewall is perpendicular to the second and third sidewalls and is connected between the second and third sidewalls. The interlayer traces are formed in the circuit board. The antenna integrated circuit is disposed on the second sidewall of the circuit board and is connected to the interlayer traces. The antenna is formed on the first sidewall of the circuit board. One of the interlayer traces is connected between the antenna integrated circuit and the antenna. The external solder pad is formed on the third sidewall of the circuit board. Another one of the interlayer traces is connected between the antenna integrated circuit and the external solder pad.

The wireless communication module further comprises a via connected between one of the interlayer traces and the antenna.

The wireless communication module further comprises a cover disposed on the second sidewall of the circuit board and covering the antenna integrated circuit.

Yet another exemplary embodiment of the invention provides a wireless communication module comprising a circuit board, a plurality of interlayer traces, an antenna integrated circuit, an antenna, and at least one external solder pad. The circuit board comprises a first sidewall, a second sidewall, and a third sidewall. The first, second, and third sidewalls are perpendicular to each other and are connected to each other. The interlayer traces are formed in the circuit board. The antenna integrated circuit is disposed on the second sidewall of the circuit board and is connected to the interlayer traces. The antenna is formed on the first sidewall of the circuit board. One of the interlayer traces is connected between the antenna integrated circuit and the antenna. The external solder pad is formed on the third sidewall of the circuit board. Another one of the interlayer traces is connected between the antenna integrated circuit and the external solder pad.

The wireless communication module further comprises a cover disposed on the second sidewall of the circuit board and covering the antenna integrated circuit.

The wireless communication module further comprises a first via and a second via. The first via is connected between one of the interlayer traces and the antenna. The second via is connected between another one of the interlayer traces and the external solder pad.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1:
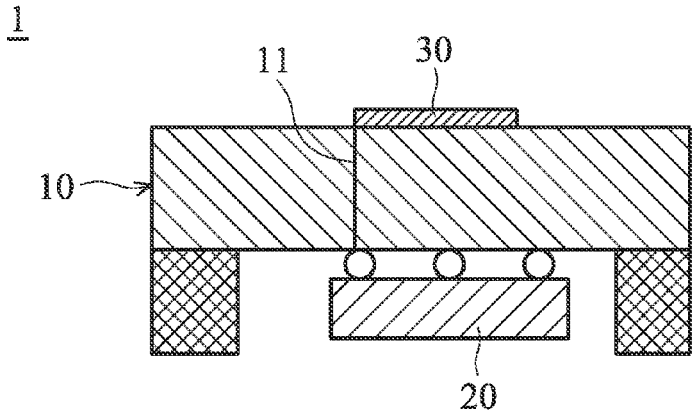
FIG. 1 ( PRIOR ART )
FIG. 1 is a schematic cross section of a conventional wireless communication module.
Figure 2:
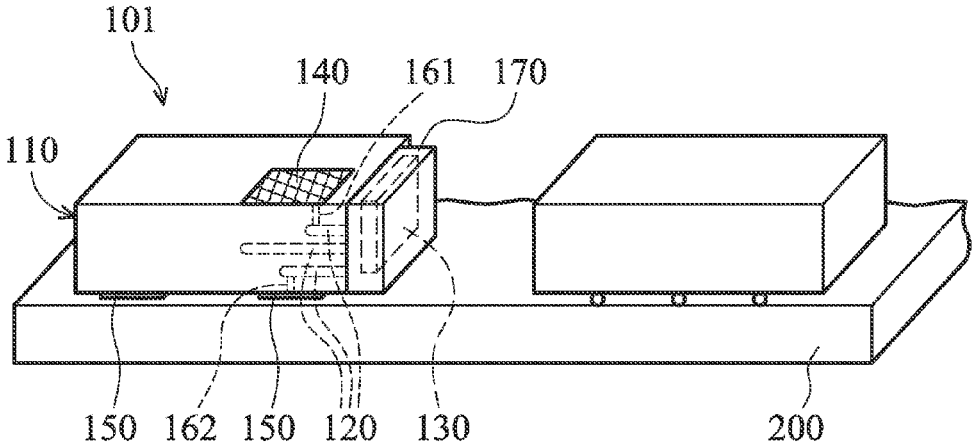
FIG. 2 shows application of a wireless communication module of a first embodiment of the invention.

Referring to FIG. 2, a wireless communication module 101 may be arranged on a substrate 200 of a wireless communication device, such as, a cellular phone.

Figure 3:
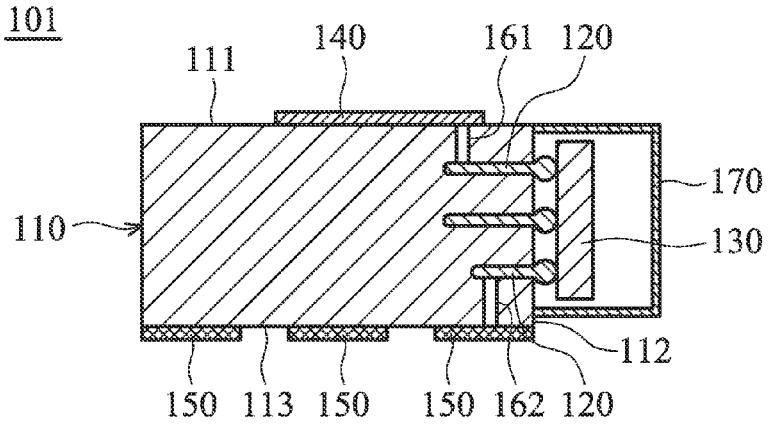
FIG. 3 is a schematic cross section of the wireless communication module of the first embodiment of the invention.

Referring to FIG. 3, the wireless communication module 101 comprises a circuit board 110, a plurality of interlayer traces 120, an antenna integrated circuit 130, an antenna 140, at least one external solder pad 150, a first via 161, a second via 162, and a cover 170.

The circuit board 110 comprises a first sidewall 111, a second sidewall 112, and a third sidewall 113. In this embodiment, the second sidewall 112 is perpendicular to the first sidewall 111 and third sidewall 113 and is connected between the first sidewall 111 and third sidewalls 113.

The interlayer traces 120 are formed in the circuit board 110.

The antenna integrated circuit 130 is disposed on the second sidewall 112 of the circuit board 110 and is connected to the interlayer traces 120. Here, the antenna integrated circuit 130 may be connected to the interlayer traces 120 using solder balls.

The antenna 140 is formed on the first sidewall 111 of the circuit board 110. Here, one of the interlayer traces 120 is connected between the antenna integrated circuit 130 and the antenna 140. Specifically, the first via 161 is connected between one of the interlayer traces 120 and the antenna 140. Namely, electrical connection between the antenna 140 and the antenna integrated circuit 130 is achieved by one of the interlayer traces 120 and the first via 161. Moreover, it is noted that the electrical connection between the antenna 140 and the antenna integrated circuit 130 may omit use of the first via 161. Namely, the electrical connection between the antenna 140 and the antenna integrated circuit 130 may be achieved by only one of the interlayer traces 120.

The external solder pad 150 is formed on the third sidewall 113 of the circuit board 110. Here, another one of the interlayer traces 120 is connected between the antenna integrated circuit 130 and the external solder pad 150. Specifically, the second via 162 is connected between another one of the interlayer traces 120 and the external solder pad 150. Namely, electrical connection between the external solder pad 150 and the antenna integrated circuit 130 is achieved by another one of the interlayer traces 120 and the second via 162.

The cover 170 is disposed on the second sidewall 112 of the circuit board 110 and covers the antenna integrated circuit 130.

As shown in FIG. 2, when being arranged on the substrate 200, the wireless communication module 101 is soldered to the substrate 200 by the external solder pad 150 thereof, electrically connecting the wireless communication module 101 to the substrate 200.

Accordingly, as the antenna integrated circuit 130 and antenna 140 are respectively disposed on the adjacent second sidewall 112 and first sidewall 111, a conductive path between the antenna integrated circuit 130 and the antenna 140 can be shortened, thereby significantly reducing impedance mismatch for the wireless communication module 101. Thus, the performance of the wireless communication module 101 can be effectively enhanced by the reduced impedance mismatch.

Second Embodiment

Elements corresponding to those in the first embodiment share the same reference numerals.

Figure 4:
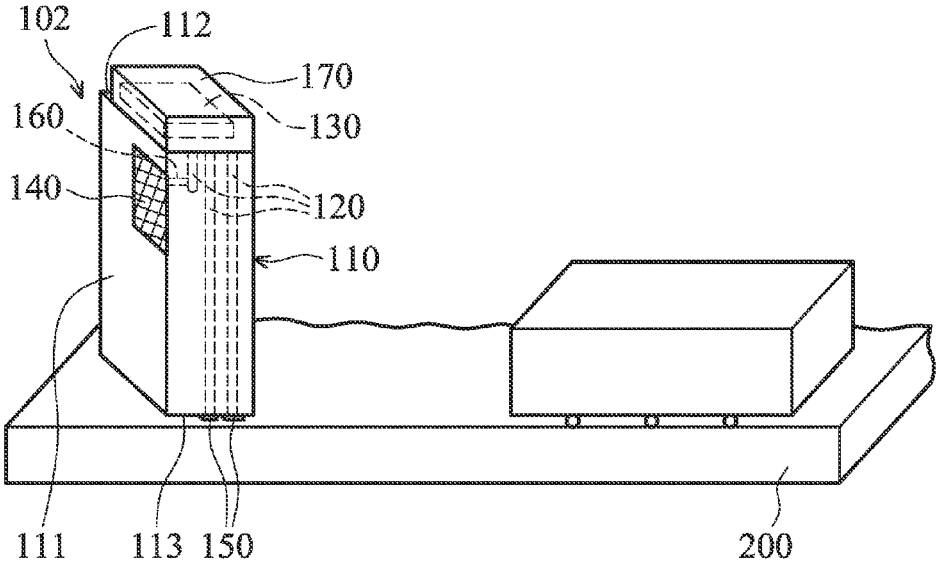
FIG. 4 shows application of a wireless communication module of a second embodiment of the invention.

Referring to FIG. 4, a wireless communication module 102 may be arranged on a substrate 200 of a wireless communication device, such as, a cellular phone.

The wireless communication module 102 comprises a circuit board 110, a plurality of interlayer traces 120, an antenna integrated circuit 130, an antenna 140, at least one external solder pad 150, a via 160, and a cover 170.

The circuit board 110 comprises a first sidewall 111, a second sidewall 112, and a third sidewall 113. In this embodiment, the first sidewall 111 is perpendicular to the second sidewall 112 and third sidewall 113 and is connected between the second sidewall 112 and third sidewalls 113.

The interlayer traces 120 are formed in the circuit board 110.

The antenna integrated circuit 130 is disposed on the second sidewall 112 of the circuit board 110 and is connected to the interlayer traces 120. Here, the antenna integrated circuit 130 may be connected to the interlayer traces 120 using solder balls.

The antenna 140 is formed on the first sidewall 111 of the circuit board 110. Here, one of the interlayer traces 120 is connected between the antenna integrated circuit 130 and the antenna 140. Specifically, the via 160 is connected between one of the interlayer traces 120 and the antenna 140. Namely, electrical connection between the antenna 140 and the antenna integrated circuit 130 is achieved by one of the interlayer traces 120 and the via 160. Moreover, it is noted that the electrical connection between the antenna 140 and the antenna integrated circuit 130 may omit use of the via 160. Namely, the electrical connection between the antenna 140 and the antenna integrated circuit 130 may be achieved by only one of the interlayer traces 120.

The external solder pad 150 is formed on the third sidewall 113 of the circuit board 110. Here, another one of the interlayer traces 120 is connected between the antenna integrated circuit 130 and the external solder pad 150.

The cover 170 is disposed on the second sidewall 112 of the circuit board 110 and covers the antenna integrated circuit 130.

As shown in FIG. 4, when being arranged on the substrate 200, the wireless communication module 102 is soldered to the substrate 200 by the external solder pad 150 thereof, electrically connecting the wireless communication module 102 to the substrate 200.

Accordingly, as the antenna integrated circuit 130 and antenna 140 are respectively disposed on the adjacent second sidewall 112 and first sidewall 111, a conductive path between the antenna integrated circuit 130 and the antenna 140 can be shortened, thereby significantly reducing impedance mismatch for the wireless communication module 102. Thus, the performance of the wireless communication module 102 can be effectively enhanced by the reduced impedance mismatch.

Third Embodiment

Elements corresponding to those in the first embodiment share the same reference numerals.

Figure 5:
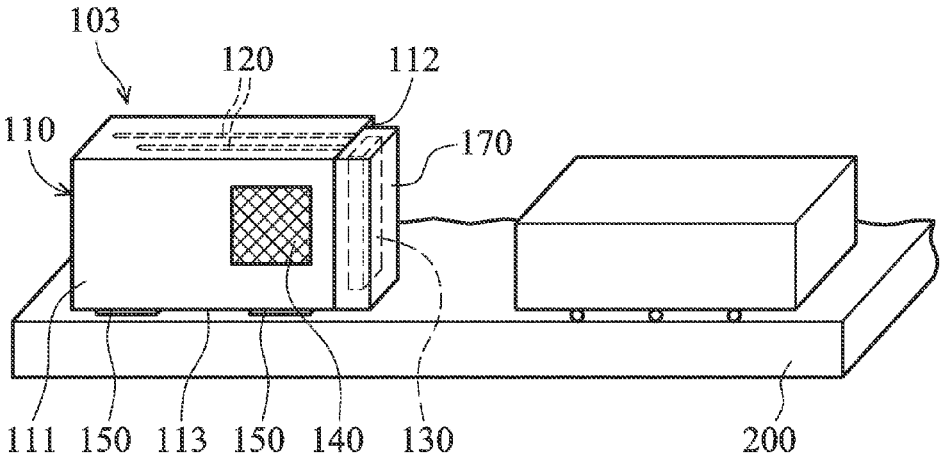
FIG. 5 shows application of a wireless communication module of a third embodiment of the invention.

Referring to FIG. 5, a wireless communication module 103 may be arranged on a substrate 200 of a wireless communication device, such as, a cellular phone.

The wireless communication module 103 comprises a circuit board 110, a plurality of interlayer traces 120, an antenna integrated circuit 130, an antenna 140, at least one external solder pad 150, a first via (not shown), a second via (not shown), and a cover 170.

The circuit board 110 comprises a first sidewall 111, a second sidewall 112, and a third sidewall 113. In this embodiment, the first sidewall 111, second sidewall 112, and third sidewall 113 are perpendicular to and connected to each other.

The interlayer traces 120 are formed in the circuit board 110.

The antenna integrated circuit 130 is disposed on the second sidewall 112 of the circuit board 110 and is connected to the interlayer traces 120. Here, the antenna integrated circuit 130 may be connected to the interlayer traces 120 using solder balls.

The antenna 140 is formed on the first sidewall 111 of the circuit board 110. Here, one of the interlayer traces 120 is connected between the antenna integrated circuit 130 and the antenna 140. Specifically, the first via is connected between one of the interlayer traces 120 and the antenna 140. Namely, electrical connection between the antenna 140 and the antenna integrated circuit 130 is achieved by one of the interlayer traces 120 and the first via. Moreover, it is noted that the electrical connection between the antenna 140 and the antenna integrated circuit 130 may omit use of the first via. Namely, the electrical connection between the antenna 140 and the antenna integrated circuit 130 may be achieved by only one of the interlayer traces 120.

The external solder pad 150 is formed on the third sidewall 113 of the circuit board 110. Here, another one of the interlayer traces 120 is connected between the antenna integrated circuit 130 and the external solder pad 150. Specifically, the second via is connected between another one of the interlayer traces 120 and the external solder pad 150. Namely, electrical connection between the external solder pad 150 and the antenna integrated circuit 130 is achieved by another one of the interlayer traces 120 and the second via.

The cover 170 is disposed on the second sidewall 112 of the circuit board 110 and covers the antenna integrated circuit 130.

As shown in FIG. 5, when being arranged on the substrate 200, the wireless communication module 103 is soldered to the substrate 200 by the external solder pad 150 thereof, electrically connecting the wireless communication module 103 to the substrate 200.

Accordingly, as the antenna integrated circuit 130 and antenna 140 are respectively disposed on the adjacent second sidewall 112 and first sidewall 111, a conductive path between the antenna integrated circuit 130 and the antenna 140 can be shortened, thereby significantly reducing impedance mismatch for the wireless communication module 103. Thus, the performance of the wireless communication module 103 can be effectively enhanced by the reduced impedance mismatch.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A wireless communication module, comprising:

a circuit board comprising a first sidewall, a second sidewall, and a third sidewall, wherein the second sidewall is perpendicular to the first and third sidewalls and is connected between the first and third sidewalls;

a plurality of interlayer traces formed in the circuit board;

an antenna integrated circuit disposed on the second sidewall of the circuit board and connected to the interlayer traces;

an antenna formed on the first sidewall of the circuit board, wherein one of the interlayer traces is connected between the antenna integrated circuit and the antenna; and at least one external solder pad formed on the third sidewall of the circuit board, wherein another one of the interlayer traces is connected between the antenna integrated circuit and the external solder pad.

2. The wireless communication module as claimed in claim 1, further comprising a first via connected between one of the interlayer traces and the antenna.

3. The wireless communication module as claimed in claim 1, further comprising a second via connected between another one of the interlayer traces and the external solder pad.

4. The wireless communication module as claimed in claim 1, further comprising a cover disposed on the second sidewall of the circuit board and covering the antenna integrated circuit.

5. A wireless communication module, comprising:

a circuit board comprising a first sidewall, a second sidewall, and a third sidewall, wherein the first sidewall is perpendicular to the second and third sidewalls and is connected between the second and third sidewalls;

a plurality of interlayer traces formed in the circuit board;

an antenna integrated circuit disposed on the second sidewall of the circuit board and connected to the interlayer traces;

an antenna formed on the first sidewall of the circuit board, wherein one of the interlayer traces is connected between the antenna integrated circuit and the antenna; and at least one external solder pad formed on the third sidewall of the circuit board, wherein another one of the interlayer traces is connected between the antenna integrated circuit and the external solder pad.

6. The wireless communication module as claimed in claim 5, further comprising a via connected between one of the interlayer traces and the antenna.

7. The wireless communication module as claimed in claim 5, further comprising a cover disposed on the second sidewall of the circuit board and covering the antenna integrated circuit.

8. A wireless communication module, comprising:

a circuit board comprising a first sidewall, a second sidewall, and a third sidewall, wherein the first, second, and third sidewalls are perpendicular to each other and are connected to each other;

a plurality of interlayer traces formed in the circuit board;

an antenna integrated circuit disposed on the second sidewall of the circuit board and connected to the interlayer traces;

an antenna formed on the first sidewall of the circuit board, wherein one of the interlayer traces is connected between the antenna integrated circuit and the antenna; and at least one external solder pad formed on the third sidewall of the circuit board, wherein another one of the interlayer traces is connected between the antenna integrated circuit and the external solder pad.

9. The wireless communication module as claimed in claim 8, further comprising a cover disposed on the second sidewall of the circuit board and covering the antenna integrated circuit.

10. The wireless communication module as claimed in claim 8, further comprising a first via and a second via, wherein the first via is connected between one of the interlayer traces and the antenna, and the second via is connected between another one of the interlayer traces and the external solder pad.

* * * * *